US006272868B1

(12) United States Patent
Grabon et al.

(10) Patent No.: US 6,272,868 B1
(45) Date of Patent: Aug. 14, 2001

(54) METHOD AND APPARATUS FOR INDICATING CONDENSER COIL PERFORMANCE ON AIR-COOLED CHILLERS

(75) Inventors: Michel Karol Grabon, Bressolles; Wahl Said, Lyons, both of (FR)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 09/526,172

(22) Filed: Mar. 15, 2000

(51) Int. Cl.[7] ..... F25B 49/02

(52) U.S. Cl. ..... 62/125; 165/11.1; 374/43; 62/129

(58) Field of Search ..... 62/125, 126, 127, 62/128, 129, 130; 165/11.1; 236/94; 340/607; 374/39, 40, 41, 43, 44

(56) References Cited

U.S. PATENT DOCUMENTS

| | | | | |
|---|---|---|---|---|
| 4,510,576 | * | 4/1985 | MacArthur et al. | 62/125 X |
| 4,885,914 | * | 12/1989 | Pearman | 62/129 |
| 5,083,438 | * | 1/1992 | McMullin | 374/40 X |
| 5,333,674 | * | 8/1994 | Czolkoss | 165/11.1 |
| 5,385,202 | * | 1/1995 | Drosdziok et al. | 165/11.1 X |

* cited by examiner

*Primary Examiner*—Harry B. Tanner
(74) *Attorney, Agent, or Firm*—Wall Marjama & Bilinski

(57) ABSTRACT

An algorithm calculates, in real time, the overall heat transfer coefficient for an air-cooled chiller system and compares this value to a reference value corresponding to a new machine operating with a clean condenser. Based on this comparison, an indication is displayed to inform a user of the degree of degradation in condenser performance.

6 Claims, 3 Drawing Sheets

METHOD AND APPARATUS FOR INDICATING CONDENSER COIL PERFORMANCE ON AIR-COOLED CHILLERS

FIELD OF THE INVENTION

The invention pertains to the field of air-cooled chillers, and in particular to a condenser coil performance indicator for an air-cooled chiller.

BACKGROUND OF THE INVENTION

A simplified typical air conditioning or refrigeration cycle includes transferring heat into a refrigerant, pumping the refrigerant to a place where heat can be removed from it, and removing the heat from the refrigerant. A refrigerant is a fluid that picks up heat by evaporating at a low temperature and pressure and gives up heat by condensing at a higher temperature and pressure. In a closed system, the refrigerant is then cycled back to the original location where heat is transferred into it. In a mechanical system, a compressor converts the refrigerant from a low temperature and low pressure fluid to a higher temperature and higher pressure fluid. After the compressor converts the refrigerant, a condenser is used to liquefy the fluid (gas) by cooling during the condensing part of the cycle. In operation, hot discharge gas (refrigerant vapor) from the compressor enters the condenser coil at the top, condenses into a liquid as heat is transferred to the outdoors. The refrigerant then passes through a metering device, such as an expansion valve, where it is converted to a low temperature, low pressure fluid before entering an evaporator.

Condensers typically use either water or air to remove heat from the refrigerant. Air-cooled condensers typically pipe the refrigerant through a coil of ample surface across which air is blown by a fan or induced natural draft. Air-cooled condensers can operate in relatively dusty environments where dust settles on the coil. Too much dust on the coil of a condenser severely degrades the performance of the refrigeration or air conditioning unit. Unit operation becomes more expensive due to the higher input power required. In extreme conditions, a dirty condenser may cause a high-pressure safety trip during hot days. Manufacturers recommend that the condenser coil be kept clean, but it is difficult for a user to tell how often a condenser should be inspected, since the frequency of inspection depends on the environment and the frequency of operation of the unit. Having information concerning condenser coil cleanliness on a real time basis would be useful to the user in optimizing a cleaning schedule.

SUMMARY OF THE INVENTION

Briefly stated, an algorithm calculates, in real time, the overall heat transfer coefficient for an air-cooled chiller system and compares this value to a reference value corresponding to a new machine operating with a clean condenser. Based on this comparison, an indication is displayed to inform a user of the degree of degradation in condenser performance.

According to an embodiment of the invention, a method for determining an operating condition of a condenser coil of a refrigeration system includes checking to see if the system is in a steady operating state; determining the saturated condensing temperature, saturated suction temperature, and ambient air temperature of the system; calculating the total heat rejected in a condenser of the system from values obtained in the preceding steps; calculating a heat transfer coefficient for the system; comparing the calculated heat transfer coefficient to an ideal heat transfer coefficient to obtain a value representing the operating condition of the condenser coil; and outputting a message to a user of the system based on the comparison of the calculated to ideal heat transfer coefficients.

DETAILED DESCRIPTION OF THE INVENTION

Figure 1:
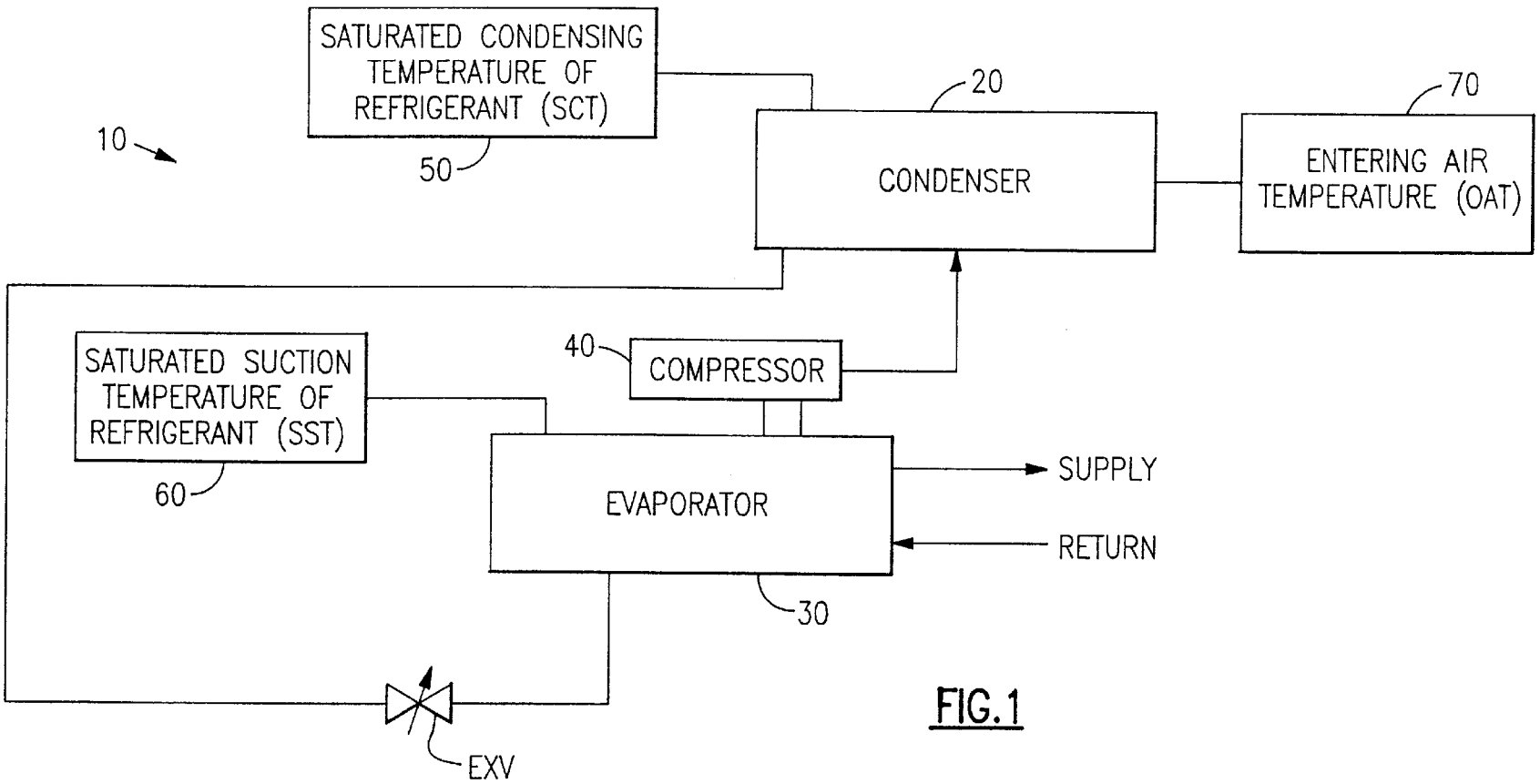
FIG. 1 shows a schematic diagram of a refrigeration system according to an embodiment of the present invention.

Referring to FIG. 1, a unit 10 includes a condenser 20 fluidly connected to an evaporator 30 through an electronic expansion valve EXV. Evaporator 30 is fluidly connected to condenser 20 through a compressor 40. Although only one compressor is shown, it is known in the art to connect more than one compressor in parallel in the same circuit. Supply air (or water) enters evaporator 30 where heat is transferred to a refrigerant. Although only one refrigerant circuit is shown, it is known in the art to use two independent refrigerant circuits. Cooler return air (or water) is circulated as necessary for cooling. A pressure transducer 50 reads the saturated condensing pressure of the refrigerant and converts the reading to the saturated condensing temperature (SCT). A pressure transducer 60 reads the saturated suction pressure of the refrigerant and converts the reading to the saturated suction temperature (SST). Pressure transducers are used because they are more accurate than known means for measuring the temperature directly. The entering air temperature (OAT), or ambient air temperature in the vicinity, is read directly, typically by a thermistor.

The total heat rejection in an air-cooled condenser can be approximated by the following equation:

$$THR=HTI*(SCT-OAT) \quad (1)$$

where THR is the total heat rejected in the condenser in kW, SCT is the saturated condensing temperature in ° C., OAT is the entering air temperature for the condenser coil in ° C., and HTI is the overall heat transfer coefficient in kW/° C. In an air-cooled chiller, the HTI value remains constant (within +/−3%) for all operating conditions, i.e., full load or partial load, if the airflow is relatively constant, which is the case if all fans in the circuit are operating. The HTI value changes significantly if a coil is dirty, if airflow drops, or if there are noncondensables in a circuit.

The unit controls monitor in real time such value as SCT, SST (saturated suction temperature), and SH (suction superheat, i.e., the difference between the actual temperature of the refrigerant and the saturated suction temperature), among others. The THR of the circuit (total heat rejection) can be calculated if a mathematical model of compressor behavior is known. It can be proven that if the compressor operates in a steady state, if a superheat is always constant, and system subcooling doesn't change too much for a given compressor model, then THR is a function of SCT and SST, that is, THR=f(SCT, SST). If the THR model is coded in the unit controls, the controls can calculate in a real time the THR based on measured system variables.

Knowing THR, SCT, and OAT it is easy to calculate in real time the value of HTI (Eq 1). The value for HTI varies with time as the condenser gets dirty. The controls compare this value to the value of a clean condenser and indicate the degradation of condenser performances to the control display.

Figure 2:
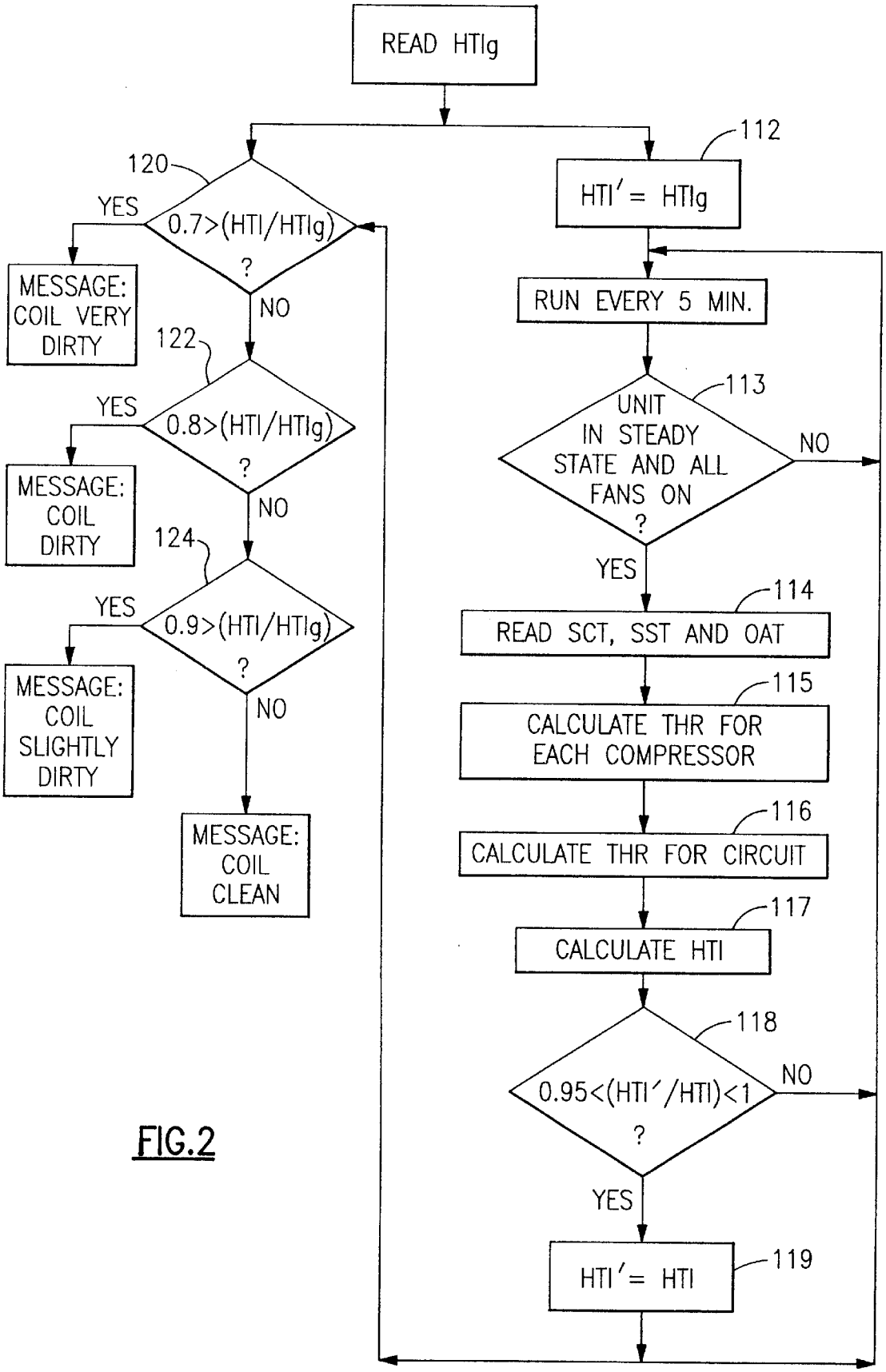
FIG. 2 shows a flow chart of a method of the present invention for determining an operating condition of a condenser coil of the refrigeration system.

Referring to FIG. 2, a method for determining HTI degradation is shown. The following symbols are used in the flow chart.

HTIg=HTI of clean machine (i.e., "good")
HTI'=the previously calculated HTI
HTI=current HTI calculation
SCT=current saturated condensing temperature (measured at 50)
SST=current saturated suction temperature (measured at 60)
OAT=current ambient air temperature (measured at 70)

HTIg is preset in the logic, with a value based on simulation and laboratory tests. Then, in step 112, HTI' is set to HTIg for the very first running of the program. If the unit is in a steady state and all fans are on (step 113), values for SCT, SST, and OAT are read into the program in step 114. A value for THR is calculated for each compressor in step 115 based on the compressor mathematical model, after which a value for the THR for the entire circuit is calculated in step 116. HTI is then calculated in step 117 using Equation (1).

The ratio of HTI' to HTI is checked in step 118 to see if it is in the range between 0.95 to 1.0. This step checks to see if the readings are within expected values. For instance, a sudden rainstorm could affect the reading for OAT in a way unrelated to the performance of the condenser. A significant difference in HTI from one cycle to the next is most likely not due to condenser performance because degradation occurs relatively slowly. Therefore, in step 118, the HTI value is compared to the HTI value of 5 minutes ago, HTI', to see if the ratio remains within logical limits. If not, the calculation cycle begins again. If so, HTI' is set to HTI in step 119 for use in the next calculation cycle.

A series of checks are made next using the ratio of HTI to HTIg. In step 120, if the ratio HTI/HTIg is less than 0.7, i.e., less than 70% of what it should be, the condenser coil is very dirty and a message to that effect is preferably displayed. In addition to or in place of messages, warning tones are optionally used. If the ratio HTI/HTIg is greater than 0.7, the ratio is checked to see if it is less than 0.8. If so, the condenser coil is dirty and a message to that effect is preferably displayed. If not, the ratio is checked to see if it is less than 0.9. If so, the condenser coil is slightly dirty and a message to that effect is preferably displayed. If not, the condenser coil is clean and a message to that effect is preferably displayed. The logic cycle repeats itself on a regular basis that is preferably five minutes, but is optionally preset by the user.

Figure 3:
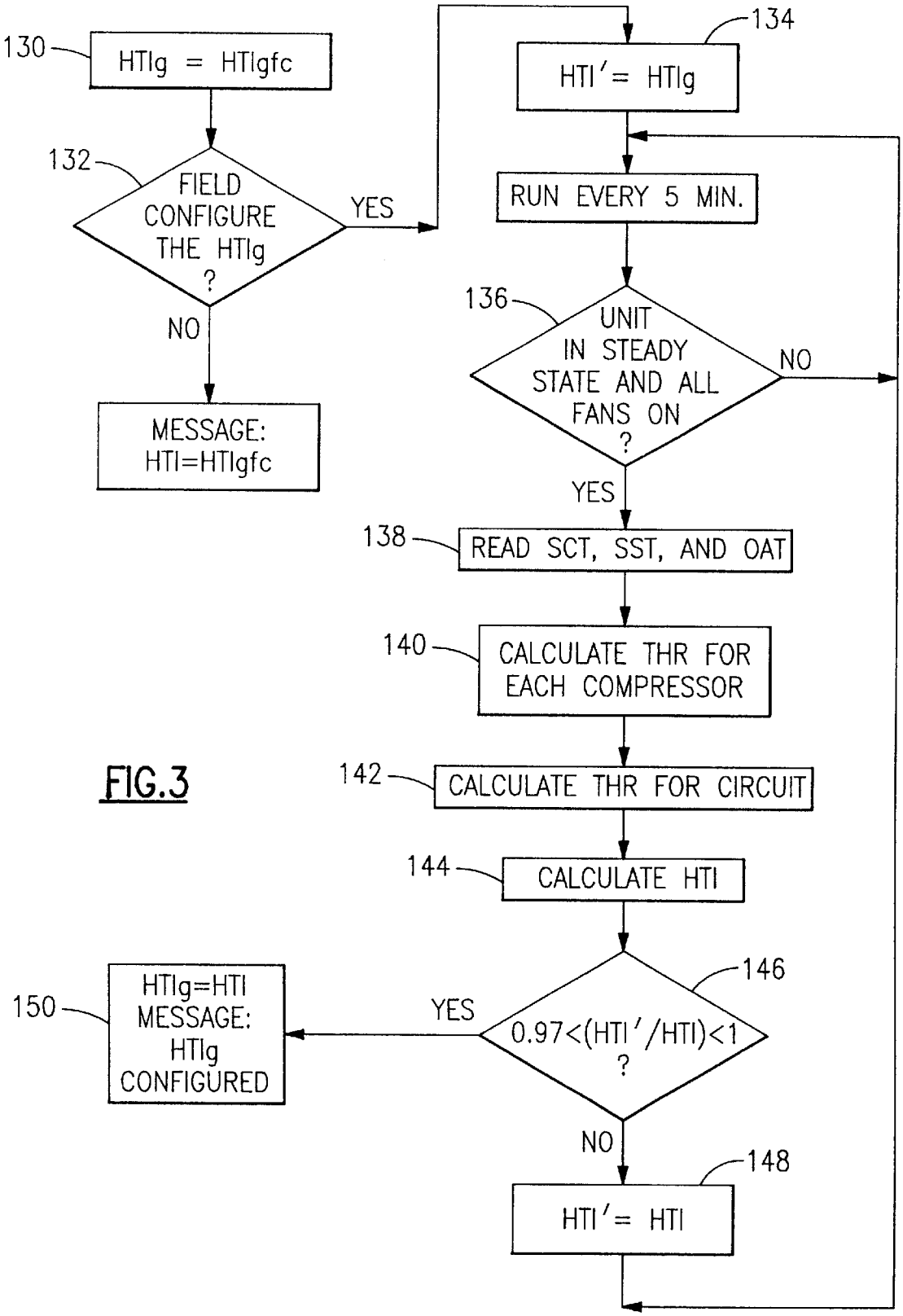
FIG. 3 shows a flow chart of a method of the present invention for initializing a value of a heat transfer coefficient for the refrigeration system.

Referring to FIG. 3, a method is shown which gives the user the option of accepting the HTIg figure from the manufacturer (denoted as HTIgfc) or determining a base line value for HTIg calculated during a commissioning process, i.e., when a service technician starts the unit for the first time when the condenser coil is still clean. The value for HTIg is initialized as HTIgfc ("good factory configured") in step 130. The user is asked in step 132 whether to accept the factory configuration or begin the field configuration. The field configuration begins in step 134 when HTI' is initialized as HTIg. If the unit is in a steady state and all fans are on (step 136), values for SCT, SST, and OAT are read into the program in step 138. A value for THR is calculated for each compressor in step 140 based on the compressor mathematical model, after which a value for the THR for the entire circuit is calculated in step 142. HTI is then calculated in step 144 using Equation (1). The ratio of HTI' to HTI is checked in step 146 to see if it is in the range between 0.97 to 1.0. If not, HTI' is set to HTI in step 148 for use in the next field configuration calculation cycle. If so, HTIg is set at HTI in step 150 and a message that HTIg is configured is preferably displayed. This field configured value of HTIg is then used in the program logic shown in FIG. 2.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

We claim:

1. A method for determining an operating condition of a condenser coil of a refrigeration system, comprising the steps of:

a) checking to see if said system is in a steady operating state;

b) determining a saturated condensing temperature of said system;

c) determining a saturated suction temperature of said system;

d) determining an ambient air temperature of said system;

e) calculating a total heat rejected in a condenser of said system from values obtained in steps (b), (c), and (d);

f) calculating a heat transfer coefficient from values obtained in steps (b), (d), and (e);

g) comparing said calculated heat transfer coefficient to an ideal heat transfer coefficient to obtain a value representing said operating condition of said condenser coil; and h) outputting a message to a user of said system based on said value obtained in step (g).

2. A method according to claim 1, wherein:

said step of comparing includes calculating a ratio of said calculated heat transfer coefficient to said ideal heat transfer coefficient; and said message is determined by comparing said ratio to at least one predetermined value.

3. A method according to claim 1, further comprising determining said ideal heat transfer coefficient from steps (a), (b), (c), (d), (e), and (f).

4. An apparatus for determining an operating condition of a condenser coil of a refrigeration system, comprising:

means for checking to see if said system is in a steady operating state;

means for determining a saturated condensing temperature, a saturated suction temperature, and an ambient air temperature of said system;

means for calculating a total heat rejected in a condenser of said system from said saturated condensing temperature, said saturated suction temperature, and said ambient air temperature;

means for calculating a heat transfer coefficient from said saturated condensing temperature, said ambient air temperature, and said total heat rejected;

means for comparing said calculated heat transfer coefficient to an ideal heat transfer coefficient to obtain a value representing said operating condition of said condenser coil; and means for outputting a message to a user of said system based on said value.

5. An apparatus according to claim 4, wherein:

said means for comparing includes calculating a ratio of said calculated heat transfer coefficient to said ideal heat transfer coefficient; and said message is determined by comparing said ratio to at least one predetermined value.

6. An apparatus according to claim 4, further comprising means for determining said ideal heat transfer coefficient.

* * * * *